US006105192A

United States Patent [19]

Deiterman et al.

[11] Patent Number: 6,105,192

[45] Date of Patent: Aug. 22, 2000

[54] SOLENOID VALVE AND TIMING MODULE FOR A FLOOR TREATING APPARATUS

[75] Inventors: Lenard Deiterman, Springdale; Gerald Courtney, Fayetteville, both of Ark.

[73] Assignee: Alto U. S., Inc., Chesterfield, Mo.

[21] Appl. No.: 09/050,539

[22] Filed: Mar. 30, 1998

[51] Int. Cl.[7] ..... A47L 11/00; F16K 31/02

[52] U.S. Cl. ..... 15/50.1; 15/320; 251/129.08; 251/129.22

[58] Field of Search ..... 15/50.1, 49.1, 15/53.1, 53.2, 320; 251/129.01, 129.08, 129.15, 129.22, 129.04

[56] References Cited

U.S. PATENT DOCUMENTS

| | | | |
|---|---|---|---|
| 3,154,890 | 11/1964 | Lemelson . | |
| 3,606,631 | 9/1971 | Vassh et al. . | |
| 3,628,213 | 12/1971 | Ramo . | |
| 3,751,755 | 8/1973 | Smith . | |
| 3,828,390 | 8/1974 | Cater . | |
| 3,974,541 | 8/1976 | Silvis et al. | 15/320 |
| 4,103,695 | 8/1978 | Aono | 251/129.08 |
| 4,107,813 | 8/1978 | Torres | 15/320 |
| 4,146,944 | 4/1979 | Pinto . | |
| 4,167,799 | 9/1979 | Webb . | |
| 4,194,262 | 3/1980 | Finley et al. . | |
| 4,214,337 | 7/1980 | Nise et al. . | |
| 4,237,571 | 12/1980 | Nelson . | |
| 4,251,896 | 2/1981 | Block . | |
| 4,317,252 | 3/1982 | Knowlton . | |
| 4,333,202 | 6/1982 | Block . | |
| 4,358,868 | 11/1982 | Cook, Jr. . | |
| 4,377,014 | 3/1983 | Slaton . | |
| 4,464,810 | 8/1984 | Karpanty . | |
| 4,580,309 | 4/1986 | Ogden . | |
| 4,658,464 | 4/1987 | Sharp . | |
| 4,782,550 | 11/1988 | Jacobs . | |
| 4,809,397 | 3/1989 | Jacobs et al. . | |
| 4,926,514 | 5/1990 | Leuenberger . | |
| 4,949,424 | 8/1990 | Shero . | |
| 4,974,282 | 12/1990 | Stoltz et al. . | |
| 5,095,578 | 3/1992 | Wade . | |
| 5,099,543 | 3/1992 | Wade . | |
| 5,173,987 | 12/1992 | Buckingham . | |
| 5,287,587 | 2/1994 | Yonkers et al. . | |
| 5,287,590 | 2/1994 | Yonkers et al. . | |
| 5,311,638 | 5/1994 | Furcron et al. . | |
| 5,383,251 | 1/1995 | Whitaker et al. . | |
| 5,388,984 | 2/1995 | Meslif | 251/129.01 |
| 5,469,598 | 11/1995 | Sales . | |
| 5,539,938 | 7/1996 | Tubbs . | |
| 5,542,147 | 8/1996 | Merten . | |
| 5,570,869 | 11/1996 | Diaz et al. . | |
| 5,584,094 | 12/1996 | Gurstein . | |
| 5,613,271 | 3/1997 | Thomas . | |
| 5,632,468 | 5/1997 | Schoenmeyr | 251/129.15 |
| 5,659,918 | 8/1997 | Anthony et al. . | |
| 5,868,164 | 2/1999 | Haskett | 251/129.08 |
| 5,921,526 | 7/1999 | Najmolhoda | 251/129.08 |

*Primary Examiner*—Robert J. Warden, Sr.
*Assistant Examiner*—Andrew Aldag
*Attorney, Agent, or Firm*—Senniger, Powers, Leavitt & Roedel

[57] ABSTRACT

A solenoid valve and timing module for use with a floor treating apparatus is disclosed. The apparatus includes a reservoir for holding a cleaning solution, a flow control valve, a head assembly adapted to carry a floor treating device, a fluid flow line for delivering the liquid supply to a supply point adjacent to the floor treating device, an operator control, and a timing module for continuously opening and closing the flow control valve in response to the operator control.

20 Claims, 4 Drawing Sheets

SOLENOID VALVE AND TIMING MODULE FOR A FLOOR TREATING APPARATUS

BACKGROUND OF THE INVENTION

The present invention relates generally to a floor treating apparatus, and more particularly to a solenoid valve and timing module to control the liquid supply system in a floor treating apparatus.

In a floor treating apparatus such as a floor scrubber, liquid from a liquid supply reservoir is supplied to a floor treating device such as a brush or a pad. The rate or amount of liquid supplied to the floor treating device is manually controlled by a choke cable and a conventional metering valve or ball valve. In order to control the amount of liquid supplied to the floor treating device, an operator must manually adjust the ball or needle valve until the desired amount of liquid supplied is achieved. It is difficult to accurately adjust the amount of liquid supplied because, as is known in the art, the design of a ball valve does not allow a linear increase or decrease in the amount of liquid that passes through the ball valve. Further, the operator must continuously open and close the ball valve to adjust the supply to avoid providing too little or too much liquid to the floor treating device. This manual operation sometimes causes undesirable liquid flow levels due to the inaccurate method of adjusting the ball valve to create the desired flow.

In addition to the inaccurate adjustment and delivery of liquid flow, the use of a ball valve in a floor treating apparatus has other drawbacks. The ball valve is normally located in the liquid flow line a few feet from the floor treating device. This causes a lag time when starting the liquid flow since the liquid must travel a few feet from the ball valve to the floor treating device when the ball valve is first opened. The location of the ball valve also causes a lag time when stopping the liquid flow since the liquid in the flow line between the ball valve and the floor treating device will continue to flow once the ball valve is closed. Another drawback to a ball valve or other conventional metering valves is that it is not always completely open when liquid is supplied. Therefore, particles tend to become trapped between the needle and seat or ball and seat thereby affecting the flow of liquid.

SUMMARY OF THE INVENTION

It is an object of this invention to provide a floor treating apparatus having a liquid delivery system which eliminates the need for a ball or needle valve and therefore eliminates the inaccurate, nonlinear manual adjustment of liquid flow due to the ball or needle valve. It is another object of this invention to provide a floor treating apparatus having a liquid delivery system which electronically controls the liquid flow from the liquid supply to the floor treating device using a timing module to continuously open and close a solenoid valve in the fluid flow line. It is still another object of this invention to provide a floor treating apparatus having a liquid delivery system with a timing module designed to control the amount of liquid supplied to the treating device by opening and closing the solenoid valve at different duty cycles to create anything from a trickle to a full flow of liquid. It is still another object of this invention to provide a floor treating apparatus having a liquid delivery system such that a timing module allows an operator to maintain a constant flow of liquid. It is another object of this invention to provide a floor treating apparatus having a liquid delivery system where a solenoid valve is placed directly at or in close proximity to the supply point at the treating device to eliminate any lag time when starting or stopping the flow of liquid. It is another object of this invention to provide a floor treating apparatus having a liquid delivery system where a solenoid valve opens completely when activated allowing particles to pass through the valve without affecting the flow of liquid. It is still another object of this invention to provide a floor treating apparatus having a liquid delivery system with linear control. It is another object of this invention to provide a floor treating apparatus having a liquid delivery system with electronic control as opposed to manual control. It is still another object of this invention to provide a floor treating apparatus having a liquid delivery system which repeatedly allows the supply of the same amount of liquid to the supply point at the treating device.

Generally, the invention comprises a floor treating apparatus for use on a floor and responsive to an operator. It includes a reservoir for holding a supply of liquid and a head assembly adapted to carry a floor treating device for engaging and treating the floor with the liquid in the reservoir. The head assembly includes a motor for rotating the floor treating device. A fluid flow line delivers liquid from the reservoir to a supply point adjacent to a point at which the floor treating device engages the floor. A flow control valve is in line with the fluid flow line for permitting liquid flow from the reservoir through the fluid flow line to the supply point when the valve is open. The flow control valve inhibits liquid flow from the reservoir through the fluid flow line to the supply point when the valve is closed. An operator control is responsive to the operator for generating an operating signal and a timing module is responsive to the operator control for opening and closing the flow control valve. The flow control valve is open for a period of time which corresponds to the operating signal. The operator controls the open period of the flow control valve via the operator control to thereby control the liquid supplied from the reservoir via the fluid flow line and the fluid control valve to the supply point.

The invention also comprises a floor treating apparatus for use on a floor comprising a reservoir for holding a supply of liquid and a head assembly adapted to carry a floor treating device for engaging and treating the floor with the liquid in the reservoir. The head assembly includes a motor for rotating the floor treating device. A fluid flow line delivers liquid from the reservoir to a supply point adjacent to a point at which the floor treating device engages the floor. A flow control valve is located in line with the fluid flow line for permitting liquid flow from the reservoir through the fluid flow line to the supply point when the valve is open. The flow control valve inhibits liquid flow from the reservoir through the fluid flow line to the supply point when the valve is closed. The floor treating apparatus also comprises a timing module for generating an operating signal for repeatedly opening and closing the flow control valve such that the flow control valve has a duty cycle wherein the flow control valve is open for a period of time which corresponds to the operating signal allowing liquid to flow from the reservoir to the supply point via the fluid flow line and the fluid control valve.

The invention also comprises a kit for use with a floor treating apparatus which engages a floor. The floor treating apparatus includes a reservoir for holding a supply of liquid; a head assembly adapted to carry a floor treating device for engaging and treating the floor with the liquid in the reservoir, said head assembly including a motor for rotating the floor treating device; and a fluid flow line for delivering cleaning fluid from the reservoir to a supply point adjacent to a point at which the floor treating device engages the floor. The kit comprises a flow control valve in line with the fluid flow line for permitting liquid flow from the reservoir through the fluid flow line to the supply point when the valve is open and for inhibiting liquid flow from the reservoir through the fluid flow line to the supply point when the valve is closed. The kit also includes a timing circuit for generating an operating signal for repeatedly opening and closing the flow control valve such that the flow control valve is open for a period of time which corresponds to the operating signal allowing liquid to flow from the reservoir to the supply point via the fluid flow line and the fluid control valve.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
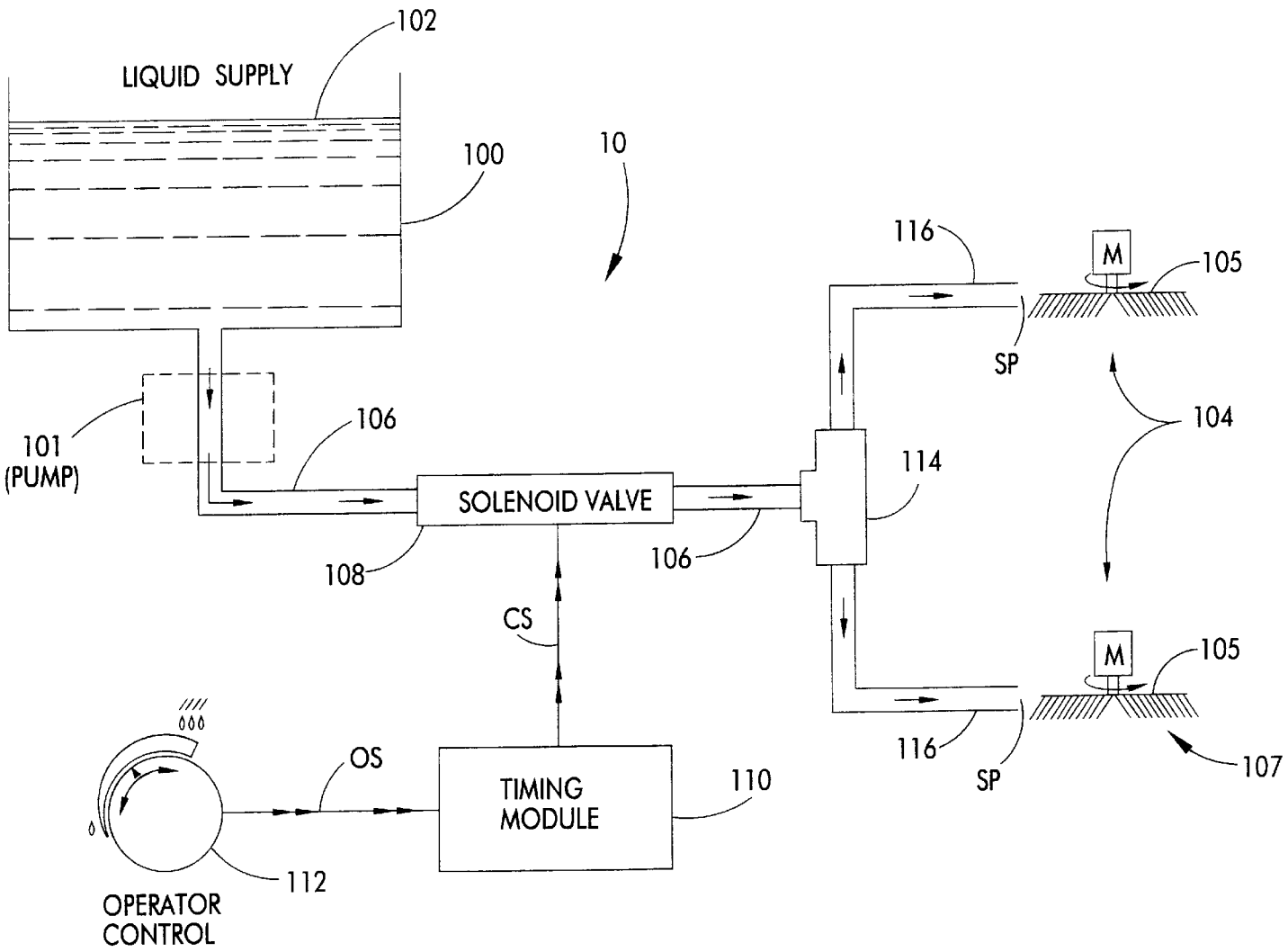
FIG. 1 is a diagrammatic view of one preferred embodiment of a liquid delivery system of a floor treating apparatus having a solenoid valve and timing module in accordance with the present invention.

Referring now to FIG. 1, one preferred embodiment of a floor treating apparatus 10 of the present invention is shown. The apparatus 10 includes a reservoir 100 for holding a supply of liquid 102. A fluid flow line 106 delivers the supply of liquid 102 from the reservoir 100 to a supply point SP adjacent to a point at which a floor treating device 104 engages the floor. The floor treating device 104 includes brushes 105 for engaging and treating a floor with the liquid 102 and motors M for rotating the brushes. A flow control valve, such as a solenoid valve 108 in line with the fluid flow line 106, controls the liquid flow in response to a timing module 110 and an optional operator control 112. (The operator control 112 is optional because the timing module may have a fixed rather than variable duty cycle, as noted below.) Although FIG. 1 shows two brushes 105, it is understood that there may be one or more than two brushes for engaging and treating a floor.

The liquid 102, such as water or cleaning solution, flows from the reservoir 100 into the fluid flow line 106 due to gravitational force. It is understood that the liquid 102 may also flow from the reservoir 100 into the fluid flow line 106 via an optional pump 101 shown in phantom. The liquid 102 flows through the fluid flow line 106 to a solenoid valve 108. When the solenoid valve 108 is in a closed position, the liquid 102 is inhibited from flowing any further through the fluid flow line 106. When the solenoid valve 108 is in an open position, the liquid 102 flows through the fluid flow line 106 via the solenoid valve 108 to the supply point SP adjacent to a point at which the floor treating device 104 engages the floor. The solenoid valve 108 may be of the type such as Deltrol Controls solenoid valve, part number DSVP11-7PX-8SR-6L5or DSVPII-1PX-8SL-645 or part number 70163-60.

It is understood that the floor treating device 104 may comprise one or more brushes 105 (as shown) or one or more pads (not shown). It is also understood that the floor treating apparatus 10 may comprise a head assembly 107 adapted to support and carry the floor treating device 104 and motors M for rotating the brushes 105. The head assembly 107 may raise and lower the floor treating device 104 for engaging and treating a floor. The floor treating apparatus 10 may also include a splitter 114, which splits the fluid flow line 106 into two fluid delivery lines 116, each of which separately delivers liquid to one of the brushes 105. Although FIG. 1 shows one fluid flow line 106, it is understood that there may be one or more fluid flow lines 106 for delivering the supply of liquid 102 from the reservoir 100 to one or more supply points SP. It is also understood that a separate solenoid valve 108 may be located in line with each fluid flow line 106.

Preferably, the solenoid valve 108 is located immediately above the supply point(s) SP to minimize any lag time in starting or stopping the supply of liquid 102 to the floor treating device(s) 104. When the apparatus 10 is initially ready for use, solenoid valve 108 is closed and there is no liquid located in the fluid flow line 106 between solenoid valve 108 and supply point SP. When solenoid valve 108 is initially opened, there may be a brief lag time in supplying liquid 102 from the solenoid valve 108 to the supply point SP. This lag time corresponds to the time required for the liquid 102 to flow through the empty fluid flow line 116 between solenoid valve 108 and supply point SP. By placing the solenoid valve 108 immediately above the supply point SP, this lag time is minimized. Similarly, when the apparatus 10 is in use and liquid is flowing through the opened solenoid valve 108, and the solenoid valve 108 is then closed, there may be a small amount of residual liquid 102 in the fluid flow line 116 between the closed solenoid valve 108 and the supply point SP causing a brief lag time while the residual liquid flows to the supply point(s) SP. By placing the solenoid valve 108 immediately above the supply point(s) SP, this lag time is also minimized.

The operator control 112 generates an operating signal OS and is responsive to an operator. The operating signal OS is provided to the timing module 110 which is responsive to the operator control 112 for selectively providing a control signal CS to the solenoid valve 108 for opening and closing the solenoid valve 108.

Figure 2:
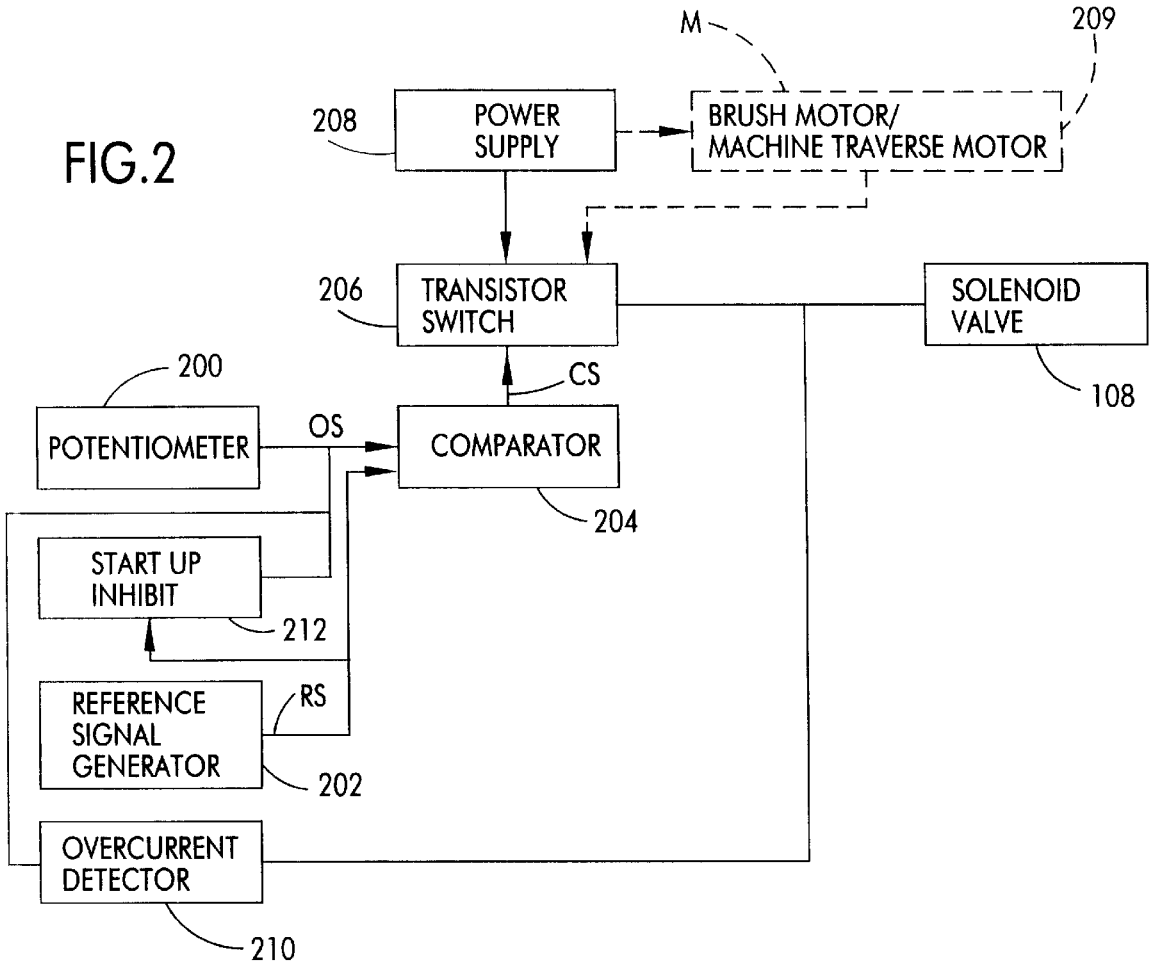
FIG. 2 is a block diagram illustrating one preferred embodiment of electrical components of the present invention.

FIG. 2 is a block diagram illustrating one preferred embodiment of the electrical components of the present invention. The operator control 112 comprises a variable resistor, such as a potentiometer 200, having a resistance which varies according to operator control. (The operator control 112 may be replaced by a fixed resistance if a fixed duty cycle and consequently a fixed flow rate is desired.) The timing module 110 comprises a reference signal generator 202, such as an oscillator, for generating a reference signal RS. The timing module 110 also comprises a comparator 204. The comparator 204 compares a parameter, such as the voltage or current, of the operating signal OS with a parameter of the reference signal RS. The comparator 204 provides a pulse width modulated output control signal CS which controls a transistor switch 206 to selectively energize and open the solenoid valve 108 by a power supply 208 to allow liquid to flow to the floor treating device 104 when the parameter of the operating signal is greater than the parameter of the reference signal. The power supply 208 is preferably a 15 volt power supply supplied by a 24 volt battery. The solenoid valve 108 is normally closed when not energized to inhibit fluid flow to the floor treating device 104 when the parameter of the operating signal OS is less than or equal to the parameter of the reference signal RS.

An alternative method of powering the transistor switch is to selectively energize the solenoid valve 108 simultaneously with the motors M for rotating the brushes 105 so that the solenoid valve 108 is only operational when the motors M for rotating the brushes 105 are operating. Similarly, the solenoid valve 108 may be selectively energized simultaneously with a machine traverse motor 209 for driving wheels which traverse the floor cleaning apparatus 10 across a floor so that the flow control valve 108 is only operational when the machine traverse motor 209 is operating and the apparatus is moving across the floor.

FIG. 2 also shows a overcurrent detector 210 and a start up inhibit 212 which inhibit the operating signal. The current detector 210 and start up inhibit 212 are discussed below in the description of FIG. 4.

Figure 3:
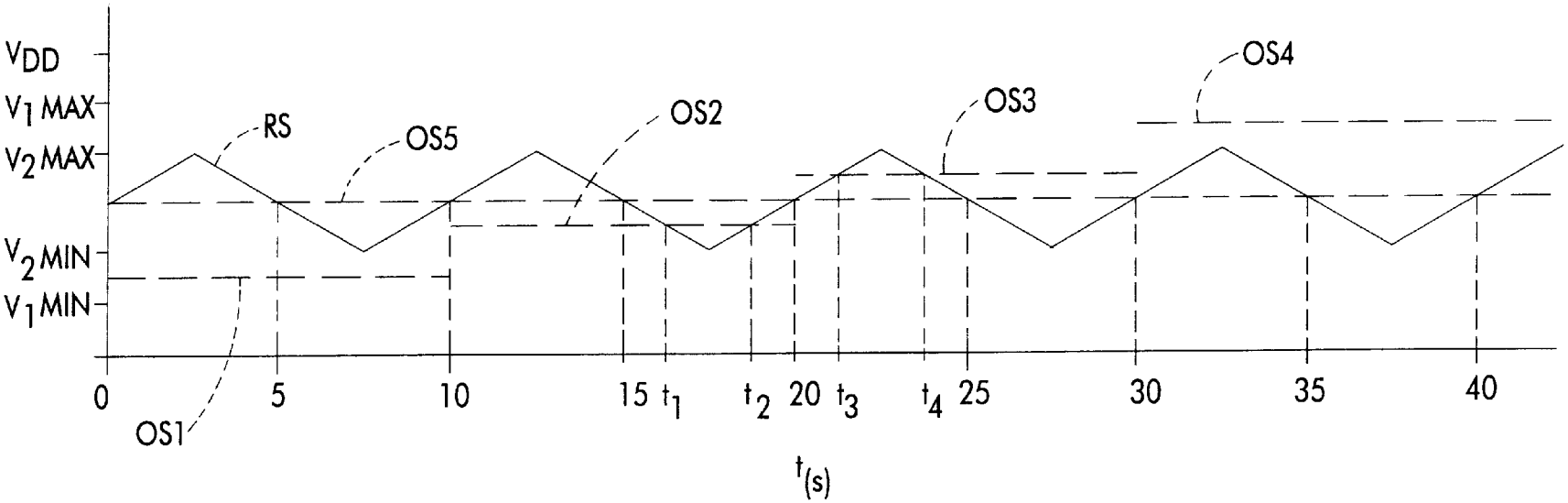
FIG. 3 is a graph illustrating time (t) along the x-axis and voltage along the y-axis of a reference signal which is compared to a voltage range for an operating signal provided by the operator control to the timing module.

FIG. 3 is a graph illustrating an example of the reference signal RS and a voltage range for the operating signal OS. The operator control 112 generates the operating signal OS that can be adjusted to a maximum voltage of $V_{1MAX}$ and a minimum voltage of $V_{1MIN}$ as shown in FIG. 3. An operator can vary the voltage of the operating signal OS between $V_{1MIN}$ to $V_{1MAX}$ by adjusting the variable resistance of the potentiometer 200 of the operator control 112. The signal generator 202 of the timing module 110 generates a periodic reference signal RS such as a triangle wave shown in FIG. 3.

In the example of FIG. 3, the reference signal RS is a triangle waveform which ranges from ⅓ $V_{DD}$ to ⅔ $V_{DD}$ so that it has a period of ten seconds and has a magnitude which varies between a maximum voltage of $V_{2MAX}$ and a minimum voltage of $V_{2MIN}$. It is preferable that the reference signal RS have a period of ten seconds in order to regularly provide liquid to the supply point SP. As the liquid 102 is supplied to the supply point SP adjacent to a point at which the floor treating device 104 engages the floor, the brushes 105 (or pads) receive with the liquid 102 and spread the liquid 102 over the floor. A reference signal RS with a longer period than ten seconds may cause dry and wet spots to occur along the floor. Further, a reference signal with a shorter period than ten seconds may cause too much noise and wear due to the frequent energizing of the solenoid valve 108. In addition, a reference signal RS having a period of ten seconds allows for maximum valve life of the solenoid valve 108.

As explained above, the output control signal CS of comparator 204 controls a transistor switch 206 which selectively energizes and opens the solenoid valve 108 to allow liquid to flow to the floor treating device 104 when a parameter of the operating signal OS is greater than a parameter of the reference signal RS. As illustrated in FIG. 3, the comparator 204 compares the voltage of the operating signal OS with the voltage of the reference signal RS. The potentiometer signal varies from slightly less than ⅓ $V_{DD}$ to slightly more than ⅔ $V_{DD}$. When the voltage of the operating signal OS is greater than the voltage of the reference signal RS, the output control signal CS of comparator 204 goes high to close the transistor switch 206 to energize and thereby open the solenoid valve 108 and to allow liquid 102 to flow to the floor treating device 104.

At the lowest setting, the voltage from the potentiometer is always lower than the triangle wave. The comparator will then give a full "off" signal for our solution valve. At the highest setting, the voltage from the potentiometer is always higher than the triangle wave. The comparator will then give a full "on" signal for our solution valve. At intermediate settings, the portion of periods where the voltage from the potentiometer is greater than the triangle wave, the comparator will turn the solenoid valve on for those respective times.

Preferably, the maximum voltage of the operating signal OS ($V_{1MAX}$) is greater than the maximum voltage of the reference signal RS ($V_{2MAX}$) and the minimum voltage of the operating signal OS ($V_{1MIN}$) is less than the minimum voltage of the reference signal RS ($V_{2MIN}$). This allows the solenoid valve 108 to fully close as the voltage of the operating signal OS decreases and approaches the minimum voltage of the reference signal RS ($V_{2MIN}$). This also allows the solenoid valve to fully open when the voltage of the operating signal increases and approaches the maximum voltage of the reference signal RS ($V_{2MAX}$). As an example, the reference signal RS may oscillate between 5 volts and 10 volts and the operating signal may vary from 4.5 volts to 10.5 volts. Referring to FIG. 3, the solenoid valve 108 will not be energized and will remain in a closed position to inhibit the flow of liquid 102 to the floor treating device 104 when the voltage of the operating signal OS is between $V_{1MIN}$ and $V_{2MIN}$. When the voltage of the operating signal OS is between $V_{2MIN}$ and $V_{2MAX}$ the solenoid valve 108 will be energized and opened for the portion of the ten second period when the voltage of the operating signal OS is greater than the voltage of the reference signal RS. It follows, then, that the solenoid valve 108 will be energized and opened for the full ten second period of the reference signal RS when the voltage of the operating signal OS is between $V_{2MAX}$ and $V_{1MAX}$.

In the example illustrated in FIG. 3, the comparator 204 compares the voltage of the operating signals OS1–OS5 with the voltage of the reference signal RS shown as a triangle wave. The solenoid valve 108 will remain closed when the voltage of an operating signal OS1 is below $V_{2MIN}$ as illustrated from 0 to 10 seconds. Similarly, the solenoid valve 108 remains open when the voltage of an operating signal OS4 is greater than $V_{2MAX}$ as illustrated from 30 to 40 seconds. When the voltage of the operating signal OS2, OS3, OS5 is between $V_{2MIN}$ and $V_{2MAX}$, the solenoid valve 108 has a duty cycle which corresponds to the operating signal. For example, if, in adjusting the operator control 112, an operator adjusts the voltage of the operating signal to a voltage OS5 between $V_{2MIN}$ and $V_{2MAX}$ then the solenoid valve 108 will have a 50% duty cycle. In other words, the voltage of the operating signal OS5 is greater than the voltage of the reference signal RS between 5 and 10 seconds, between 15 and 20 seconds and between 25 and 30 seconds and between 35 and 40 seconds. Therefore, for every 10 second period of the reference signal RS, the comparator 204 closes the transistor switch 208 to open the solenoid valve 108 for 5 seconds. This cycle repeats until the operator changes the voltage of the operating signal OS5 by adjusting the operator control 112.

FIG. 3 illustrates two more examples of operating signals OS2 and OS3 between $V_{2MIN}$ and $V_{2MAX}$. Operating signal OS2 is illustrated in FIG. 3 from 10 to 20 seconds. In comparing this operating signal OS2 to the reference signal RS, the solenoid valve 108 remains closed from 10 seconds to $t_1$ because the voltage of operating signal OS2 is less than the voltage of reference signal RS for that time. Solenoid valve 108 opens from $t_1$ to $t_2$ because the voltage of operating signal OS2 is greater than the voltage of the reference signal RS during this interval. The solenoid valve 108 then closes from $t_2$ to 20 seconds because the voltage of the operating signal OS2 is less than the voltage of the reference signal RS. This cycle continues for each ten second period of reference signal RS until the operator changes the voltage of the operating signal OS2 by adjusting the operator control 112. Operating signal OS3 is illustrated in FIG. 3 from 20 to 30 seconds. In comparing this operating signal OS3 to reference signal RS, the solenoid valve 108 is open from 20 seconds to $t_3$ because the voltage of operating signal OS3 is greater than the voltage of reference signal RS for that time. Solenoid valve 108 then closes from $t_3$ to $t_4$ because the voltage of operating signal OS3 is less than the voltage of reference signal RS. From $t_4$ to 30 seconds, the solenoid valve 108 opens again. This cycle continues for each ten second period of reference signal RS until the operator changes the voltage of the operating signal OS3 by adjusting the operator control 112.

Although a reference signal RS having a ten second period (duty cycle) is preferred, it is understood that a reference signal RS having a shorter or longer period may be used. The duty cycle of the solenoid valve 108 may vary depending on the period of the reference signal RS generated by the reference signal generator 202. As noted above, it has been found that a 10 second duty cycle is short enough to provide a substantially continuous delivery of liquid and is long enough to minimize solenoid valve cycling so that the life of the solenoid valve is not substantially shortened.

Figure 4:
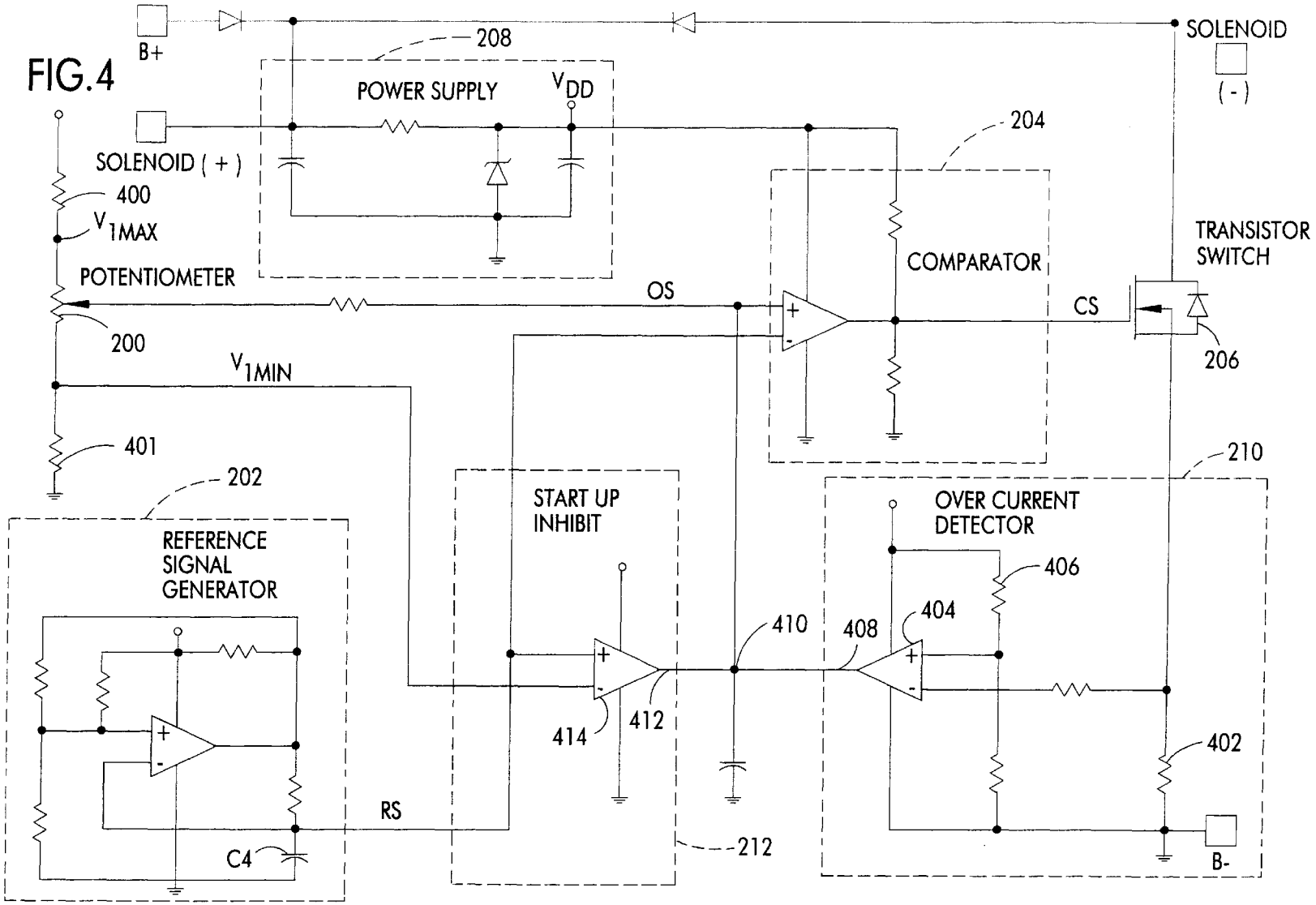
FIG. 4 is an electrical schematic of one preferred embodiment of the control module for the present invention including a power supply, potentiometer, comparator, overcurrent detector, start up inhibit, and oscillator.

FIG. 4 is an electrical schematic diagram of one preferred embodiment of the control module for the present invention further detailing the electrical components of the block diagram of FIG. 2. FIG. 4 specifically illustrates the components for the potentiometer 200, reference signal generator 202, switch control comparator 204, transistor switch 206, power supply 208, overcurrent detector 210 and start up inhibit 212 according to the present invention. Preferably, the potentiometer 200 is a variable resistor having a range from 0 to 5000 ohms in series with two additional resistors 400 and 401 having resistances of 4600 ohms each. The solenoid valve 108 is connected to Solenoid+ on the high side and Solenoid− on the low side.

The overcurrent detector 210 protects the timing module and particularly switch 206 from excessive current. The current through the switch 206 is detected by shunt resistor 402 and applied to an inverting (−) input pin of a comparator 404. A voltage defined by resistor 406 corresponding to the maximum allowable current is applied to a non-inverting (+) input pin of the comparator 404. When the switch current exceeds the maximum current, the inverting (−) input pin carries a higher voltage than the non-inverting (+) input pin of comparator 404 which causes an output 408 of the comparator to go low. The output 408 is connected to a junction 410 which is connected to the operating signal OS from the potentiometer 200. The output 408 pulls junction 410 low to ground the operating signal OS and disables the transistor switch 206 from closing the solenoid valve 108 since the voltage of the operating signal OS input to the non-inverting (+) input pin of comparator 204 will not be greater than the reference signal RS applied to the inverting (−) input pin. The overcurrent detector 210 also detects short circuits in the solenoid circuit by detecting large currents through the switch 206 and disabling the switch in response thereto.

The start up inhibit 212 prevents an undesired flow of liquid 102 from being supplied to the floor treating device 104 when the floor treating apparatus 10 is initially started. When the floor treating apparatus 10 is first powered up, the capacitor C4 is probably fully discharged and must charge up to the minimum voltage ($V_{2MIN}$) of the reference signal RS. Once it is fully charged, the capacitor C4 charges and discharges between the minimum voltage $V_{2MIN}$ and maximum voltage $V_{2MAX}$ to generate the reference signal RS as long as the floor treating apparatus 10 is continuously provided with power from the power supply 208. Without the start up inhibit 212, when the floor treating apparatus 10 is first powered up, the fully discharged capacitor C4 causes the voltage of the reference signal RS at the inverting (−) input pin of the comparator 204 to be low. Since the voltage of the operating signal OS will likely be greater than the initial, charging voltage of the reference signal RS when the floor treating apparatus is first started, the transistor switch 206 will be energized by comparator 204 causing the solenoid valve 108 to open and allow liquid 102 to flow to the floor treating device 104. This causes an undesired supply of liquid 102 to the floor treating device 104 for the period of time during which the capacitor C4 charges to the minimum voltage $V_{2MIN}$ of the reference signal RS. The start up inhibit 212 prevents this undesired supply of liquid 102 by pulling junction 410 low until the voltage of the capacitor C4 reaches the minimum voltage of reference signal RS. A low output 412 of a start up inhibit op amp 414 of start up inhibit circuit 212 prevents the voltage of the operating signal OS from being higher than the voltage of the reference signal RS for the time it takes C4 to charge to the minimum voltage $V_{2MIN}$ of the reference signal RS, thereby preventing the output control signal CS of comparator 204 from energizing the transistor switch 206. The low output 412 of start up inhibit op amp 414 is present as long as the voltage of the reference signal RS (which is applied to its non-inverting (+) input pin) is less than the minimum voltage $V_{1MIN}$ (which is applied to its inverting (−) input pin). In other words, the start up inhibit op amp 414 does not allow the voltage of the reference signal generator 202 to be compared with the voltage of the potentiometer 200 until the voltage of the reference signal generator 202 rises above $V_{1MIN}$. (It puts a $V_{1MIN}$ shift in the required reference signal generator output voltage.) Until the voltage of the reference signal generator 202 rises into this valid region, the output of the start up inhibit op amp 414 pulls the operating signal OS at the comparator input down. (This would be similar to turning the potentiometer 200 all the way down, and expecting the water flow to stop.) The solenoid valve 108 is thereby kept closed during start up, inhibiting liquid 102 from flowing to the floor treating device 104. Once the capacitor C4 charges to the minimum voltage $V_{2MIN}$ of the reference signal RS, the system works as described above, opening the solenoid valve 108 when the voltage of the operating signal OS is greater than the voltage of the reference signal RS.

It is also contemplated that the invention may be a kit which is retrofitted to an existing floor cleaning apparatus. In particular, the existing ball valve and cable control would be replaced by the flow control valve and timing circuit (and optional operator control).

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A floor treating apparatus for use on a floor and responsive to an operator comprising:

a reservoir for holding a supply of liquid;

a head assembly adapted to carry a floor treating device for engaging and treating the floor with the liquid in the reservoir, said head assembly including a motor for rotating the floor treating device;

a fluid flow line for delivering liquid from the reservoir to a supply point adjacent to a point at which the floor treating device engages the floor;

a flow control valve in line with the fluid flow line for permitting liquid flow from the reservoir through the fluid flow line to the supply point when the valve is open and for inhibiting liquid flow from the reservoir through the fluid flow line to the supply point when the valve is closed;

an operator control responsive to the operator for generating an operating signal; and a timing module responsive to the operator control for opening and closing the flow control valve such that the flow control valve is open for a period of time which corresponds to the operating signal whereby the operator controls the open period of the flow control valve via the operator control to thereby control the liquid supplied from the reservoir via the fluid flow line and the fluid control valve to the supply point.

2. The floor treating apparatus of claim 1 wherein the timing module opens and closes the flow control valve such that the flow control valve has a duty cycle which corresponds to the operating signal whereby the operator controls the duty cycle of the flow control valve via the operator control to thereby control the flow rate of liquid supplied from the reservoir via the fluid flow line and the fluid control valve to the supply point.

3. The floor treating apparatus of claim 2 wherein the timing module comprises a reference signal generator for generating a reference signal and a comparator for comparing a parameter of the operating signal and a parameter of the reference signal, wherein the timing module opens the flow control valve to allow fluid to flow to the supply point when the parameter of the operating signal is greater than the parameter of the reference signal, and closes the flow control valve to inhibit fluid flow to the supply point when the parameter of the operating signal is less than the parameter of the reference signal.

4. The floor treating apparatus of claim 3 further comprising a transistor switch responsive to the output of the comparator for energizing the flow control valve.

5. The floor treating apparatus of claim 3 wherein a minimum of the parameter of the reference signal is greater than a minimum of the parameter of the operating signal and a maximum of the parameter of the reference signal is less a maximum of the parameter of the operating signal.

6. The floor treating apparatus of claim 3 wherein the reference signal generator for generating the reference signal comprises an oscillator.

7. The floor treating apparatus of claim 3 wherein the reference signal comprises a periodic signal.

8. The floor treating apparatus of claim 7 wherein the periodic signal has a period of ten seconds.

9. The floor treating apparatus of claim 8 wherein the periodic signal is a triangle wave.

10. The floor treating apparatus of claim 3 wherein each parameter of said operating and reference signals comprises voltage and wherein the operator control comprises a variable resistor having a resistance controlled by the operator.

11. The floor treating apparatus of claim 10 wherein the variable resistor comprises a potentiometer.

12. The floor treating apparatus of claim 1 wherein the operating signal is indicative of an amount of liquid to be supplied from the reservoir to the supply point.

13. The floor treating apparatus of claim 1 wherein the operating signal is indicative of a rate of flow of liquid to be supplied from the reservoir to the supply point.

14. The floor treating apparatus of claim 1 wherein the flow control valve is a solenoid valve.

15. The floor treating apparatus of claim 1 wherein the flow control valve is selectively energized simultaneously with the motor for rotating the floor treating device so that the flow control valve is only operational when the motor for rotating the floor treating device is operating.

16. The floor treating apparatus of claim 1 further comprising a machine traverse motor for traversing the floor treating apparatus across the floor wherein the flow control valve is selectively energized simultaneously with the machine traverse motor so that the flow control valve is only operational when the machine traverse motor is operating.

17. The floor treating apparatus of claim 1 further comprising a start-up inhibit circuit which initially inhibits operation of the flow control valve when the apparatus is initially energized.

18. A floor treating apparatus for use on a floor comprising:

a reservoir for holding a supply of liquid;

a head assembly adapted to carry a floor treating device for engaging and treating the floor with the liquid in the reservoir, said head assembly including a motor for rotating the floor treating device;

a fluid flow line for delivering liquid from the reservoir to a supply point adjacent to a point at which the floor treating device engages the floor;

a flow control valve in line with the fluid flow line for permitting liquid flow from the reservoir through the fluid flow line to the supply point when the valve is open and for inhibiting liquid flow from the reservoir through the fluid flow line to the supply point when the valve is closed; and a timing module for generating a control signal in response to an operating signal for repeatedly opening and closing the flow control valve such that the flow control valve has a duty cycle wherein the flow control valve is open for a period of time which corresponds to the operating signal allowing liquid to flow from the reservoir to the supply point via the fluid flow line and the fluid control valve.

19. The treating apparatus of claim 18 wherein the timing module further comprises a reference signal generator for generating a reference signal and a comparator for comparing a parameter of the operating signal and a parameter of the reference signal such that the timing module opens the flow control valve to allow fluid to flow to the supply point when the parameter of the operating signal is greater than the parameter of the reference signal, and closes the flow control valve to inhibit fluid flow to the supply point when the parameter of the operating signal is less than the parameter of the reference signal.

20. The treating apparatus of claim 19 further comprising an operator control responsive to an operator for adjusting the parameter of the operating signal wherein the timing module is responsive to the operator control for opening and closing the flow control valve such that the flow control valve is open for a period of time which corresponds to the operating signal whereby the operator controls the open period of the flow control valve via the operator control to thereby control the liquid supplied from the reservoir via the fluid flow line and the fluid control valve to the supply point.

* * * * *